United States Patent [19]

Tsuchitani et al.

[11] Patent Number: 4,789,456

[45] Date of Patent: Dec. 6, 1988

[54] PROCESS FOR PREPARING MESOPHASE PITCHES

[75] Inventors: Masatoshi Tsuchitani, Ichihara; Sakae Naito, Chiba; Ryoichi Nakajima, Ichihara, all of Japan

[73] Assignees: Agency of Industrial Science and Technology; Maruzen Petrochemical Co., Ltd., both of Tokyo, Japan

[21] Appl. No.: 48,415

[22] Filed: May 11, 1987

[30] Foreign Application Priority Data

May 26, 1986 [JP] Japan ..... 61-119299

[51] Int. Cl.[4] ..... C10C 3/02; C10C 3/00

[52] U.S. Cl. ..... 208/39; 208/40; 208/41; 208/44; 208/22; 423/447.4

[58] Field of Search ..... 208/39, 40, 41; 423/447.4

[56] References Cited

U.S. PATENT DOCUMENTS

| | | | |
|---|---|---|---|
| 2,944,958 | 7/1960 | Goldthwait et al. | 208/39 |
| 3,928,169 | 12/1975 | Conroy | 208/40 |
| 4,271,006 | 6/1981 | Dickakian | 208/41 |
| 4,363,715 | 12/1982 | Dickakian | 208/40 |
| 4,427,530 | 1/1984 | Dickakian | 208/40 |
| 4,460,557 | 7/1984 | Takashima et al. | 208/39 |
| 4,462,894 | 7/1984 | Moriya et al. | 208/40 |
| 4,497,789 | 2/1985 | Sawran et al. | 208/40 |
| 4,512,874 | 4/1985 | Watanabe | 208/40 |
| 4,529,499 | 7/1985 | Watanabe | 208/39 |
| 4,589,975 | 5/1986 | Yudate et al. | 208/39 |
| 4,596,652 | 6/1986 | Shibatani et al. | 208/39 |
| 4,663,021 | 5/1987 | Arai et al. | 208/40 |
| 4,705,618 | 11/1987 | Tsuchitani et al. | 208/44 |

FOREIGN PATENT DOCUMENTS

| | | | |
|---|---|---|---|
| 54-55625 | 5/1979 | Japan . | |
| 58-136835 | 8/1983 | Japan . | |
| 58-196292 | 11/1983 | Japan . | |
| 58-214531 | 12/1983 | Japan . | |
| 59-82417 | 5/1984 | Japan . | |
| 59-164386 | 9/1984 | Japan . | |
| 61-103989 | 5/1986 | Japan . | |
| 1163991 | 7/1986 | Japan | 208/40 |
| 61-238885 | 10/1986 | Japan . | |
| 1234418 | 5/1986 | U.S.S.R. | 208/30 |

*Primary Examiner*—H. M. S. Sneed
*Assistant Examiner*—Helane Myers
*Attorney, Agent, or Firm*—Frishauf, Holtz, Goodman & Woodward

[57] ABSTRACT

A process for an efficient preparation of a mesophase pitch is disclosed. The process is suitable for the production of high performance carbon fibers, from a coal tar or a petroleum residual oil. More particularly, the present invention relates to a process for the preparation of a homogeneous mesophase pitch which comprises a continuous thermal treatment of a heavy oil or a pitch which does not contain quinoline insoluble fractions, in the presence or absence of an aromatic oil, subsequent distillation of the thermally treated product, recovery of a pitch with extremely low quinoline insoluble contents, hydrogenation of the pitch by continuous thermal treatment in the presence of a hydrogen-donating solvent, distillation and recovery of a hydrogenation pitch, and thermal treatment of the hydrogenated pitch. The mesophase pitch prepared by the process of the present invention is suitable for the production of high performance carbon fibers.

6 Claims, No Drawings

PROCESS FOR PREPARING MESOPHASE PITCHES

BACKGROUND OF THE INVENTION

1. Field of the Invention

The present invention relates to a process for an efficient preparation of a mesophase pitch which is suitable for the production of high performance carbon fibers, from a coal tar or a petroleum residual oil. More particularly, the present invention relates to a process for the preparation of a homogeneous mesophase pitch which comprises a continuous thermal treatment of a heavy oil or a pitch which does not contain quinoline insoluble fractions, and preferably contain no or substantially no xylene insoluble fraction, in the presence or absence of an aromatic oil, subsequent distillation or flash distillation of the thermally treated product in a distillation or flash distillation column, recovery of a pitch with extremely low quinoline insoluble contents from the bottom of the distillation or flash distillation column, hydrogenation of the pitch by a continuous thermal treatment in the presence of a hydrogen-donating solvent, distillation or flash distillation of the hydrogenated reaction products in a distillation or flash distillation column and recovery of a hydrogenated pitch from the bottom of the distillation or flash distillation column, and a thermal treatment of the hydrogenated pitch. The mesophase pitch prepared by the process of the present invention is suitable for the production of high performance carbon fibers.

Since high performance carbon fibers are light in weight and show high tensile strength and high modulus of elasticity, they are currently attracting a wide concern as components of composite materials used for airplanes, sports goods, industrial robots, etc., and a great increase in demand is expected.

2. Description of the Prior Art

Heretofore, high performance carbon fibers are mainly polyacrylonitrile (PAN) based carbon fibers which are produced by spinning of PAN, conversion to infusible state in an oxidizing atmosphere, and subsequent carbonization or graphitization under an inert atmosphere. However, the production of PAN-based carbon fibers suffers from several disadvantages. For example, the raw materials of PAN-based carbon fibers are expensive, the carbonization yields are low, and toxic substances are produced during the production. Recently, it has been found that high performance carbon fibers, with properties equal or superior to those of PAN-based carbon fibers, can be produced from a mesophase pitch, without the problems associated with PAN-based fibers.

In the production of high performance carbon fibers from a pitch, it is necessary that the spinning pitch should be a so-called mesophase pitch, which means that it contains mainly mesophase showing an optical anisotropy when examined on a polarized microscope.

The mesophase belongs to a class of liquid crystals which are formed on heating of a heavy oil or a pitch, and it is considered that it shows an optical anisotropy because planar aromatic molecules, formed by thermal polymerization, align themselves in a layered structure. When fibers are produced by melt spinning from such a mesophase pitch, the planar aromatic molecules align themselves along the axis of the fiber by the stress exerted during passage through a nozzle hole, and this aligned structure is maintained throughout the steps of the conversion to an infusible state and carbonization processes, and thus allows production of highly oriented high performance carbon fibers.

As the raw material for the production of such a mesophase pitch, heavy oils such as coal tars, tar by-products from naphtha thermal cracking, tar by-products from gas oil thermal cracking, and decant oils from catalytic cracking, or pitches derived from the heavy oils may be used.

It has been known that such raw materials contain quinoline insoluble fractions like free carbons in coal tars which mean very fine sooty substances with a diameter of 0.1–0.3 microns, or highly polymerized components, and a high quality mesophase pitch with a high degree of orientation cannot be produced from a raw material containing such free carbons, because the layered structure of planar aromatic molecules which are constituent of mesophase is disturbed by deposition of free carbons on the mesophase. Further, a high quality mesophase cannot be produced from a pitch containing highly polymerized components because they are converted to coke-like substances during thermal treatment. Therefore, it is essential that these impurities should be eliminated during one of the steps for the production of a mesophase pitch. However, when a mesophase pitch which has mesophase content of more than 80% is produced by thermal treatment after a simple removal of these impurities and without any other pretreatments, it shows a softening point of higher than 330° C. measured by Mettler method. A spinning temperature of higher than 360° C. is required for spinning of such a pitch. Since this is a temperature range where organic compounds generally decompose, spinning at these temperatures give rise to problems such as breaking off of fibers and lowering of tensile strength.

For example, Japanese Patent Laid-open No. 54(1979)-55625 discloses a process wherein a previously filtered pitch is heated at a temperature range of 380°–430° C., at a residence time range of 5–44 hr while bubbling an inert gas. By this process, however, mesophase pitches obtained have a softening point range of 330°–350° C. And, in a example of the invention, a mesophase pitch having a softening point of 341° C. is spun at a high temperature of 372° C.

Also, Japanese Patent Laid-open No. 59(1984)-164386 discloses a process which comprises heat-treating a pitch at a temperature range of 350°–500° C. to form 10–30 wt% of mesophase in the pitch, removing the formed mesophase by solvent extraction, and heat-treating the solvent soluble pitch thus obtained. By this process, however, softening point of the mesophase pitch shown in the example is higher than 350° C. Accordingly, spinning is conducted at a temperature of higher than 370° C.

Japanese Patent Laid-open No. 58(1983)-136835 discloses a process which is nearly the same as the process of Japanese Patent Laid-open No. 59-(1984)-164386, but it does not disclose about the properties of mesophase pitch or the conditions of spinning.

Further, Japanese Patent Laid-open No. 59(1984)-82417 discloses a process which comprises heat-treating a heavy residual oil having a boling point of higher than 410° C. at atmospheric pressure, removing the formed insoluble fractions by filtration or centrifugation at a temperature range of 200°–350° C., and vacuum distillating the refined pitch at a temperature range of 370°–390° C. In this Japanese Patent Laid-open No. 59(1984)-82417, softening point of a mesophase pitch is not disclosed, however, spinning is conducted at a temperature of higher than 365° C.

Additionally, it is well known that the insoluble fractions formed by the heat treatment of residual oils or pitches contain fine mesophase spheres, and that it is extraordinarily difficult to remove the fine mesophase spheres from the pitches obtained by the heat treatment. Accordingly, removal of the insoluble fractions is not economical and not practical.

A few processes have been proposed which will avoid the disadvantages. For example, Japanese Patent Laid-open Nos. 58(1983)-214531 and 58(1983)-196292 disclose processes for the preparation of a mesophase pitch, which comprise conducting a thermal treatment of a pitch, in the presence of a hydrogen-donating solvent and in the presence or absence of hydrogen gas, and after removal of insoluble fractions formed and the solvent used, further conducting thermal treatment. A mesophase pitch prepared by these processes has a low softening point and excellent spinning properties, and the carbon fibers produced from this pitch have excellent characteristics.

In Japanese Patent Laid-open Nos. 58(1983)-214531 and 58(1983)-196292 mentioned above, however, the hydrogenation of a pitch is carried out by a batch process in an apparatus such as an autoclave. As the hydrogenation of a pitch is generally carried out at a high temperature above 400° C., when heating is applied from the outside of a large apparatus such as an autoclave, the temperature of the wall of the apparatus tends to become considerably high, and the formation of cokes cannot be avoidable. Although hydrogenation of a pitch is very effective for the preparation of a spinning pitch for the production of high performance carbon fibers, when hydrogenation is performed by a batch process, an additional process for removal of quinoline insoluble fractions is required. Moreover, since the hydrogenation is usually carried out under a high pressure, this process requires a high cost in the construction of the apparatus, and temperature control becomes increasingly difficult as the size of the apparatus becomes larger.

Also, U.S. Pat. No. 4,589,975 discloses a process which comprises hydro-treating a pitch in the presence of tetralin, removing insoluble fractions and solvent used, and heat-treating the hydro-treated pitch. In this process, since tetralin acts as a poor solvent, considerable amounts of insoluble fractions are formed in the hydro-treated material. Accordingly, this hydro-treatment can be conducted only by batch procss. As mentioned above, batch process of the hydro-treatment is not economical.

In the circumstances above, development of a process has been desired which reduces the formation of undesirable fractions in each step during the preparation of a pitch for the production of high performance carbon fibers, and requires no means for the removal of the undesirable fractions.

We have proposed processes for the production of pitches suitable for use as the raw material for the production of carbon fibers (Japanese Patent Laid-open Nos. 61(1986)-103989 and 61(1986)-238885). Although these processes are meritorious in many points, we consider that there are still some points to be improved.

SUMMARY OF THE INVENTION

After an intensive investigation toward establishing an efficient process which prevents the formation of undesirable fractions during preparation of a homogeneous spinning pitch, which is suitable for the production of high performance carbon fibers, from purified heavy oils or pitches, we have successfully completed the present invention by the findings that the objects described above can be effectively realized with an extremely low-yield formation of undesirable fractions, when purified heavy oils or pitches which do not contain quinoline insoluble fractions, and preferably contain no or substantially no xylene insoluble fraction, are treated by the three steps described above, i.e., a continuous thermal treatment and distillation or flash distillation; a continuous hydrogenation treatment and distillation or flash distillation; and the final thermal treatment for conversion into a mesophase pitch.

In the process of this invention, since the first thermal treatment and the hydrogenation treatment are conducted continuously within tubular heaters in a short or relatively short time, the formation of coke-like solid materials can be avoided in a minimum and the fluctuation of the quality of the pitch products can be prevented effectively, and pitches with excellent quality can be obtained stably.

Therefore, the primary object of the present invention is to provide a simplified and readily workable process which extremely reduces the formation of undesirable fractions during the preparation of a spinning pitch for the production of high performance carbon fibers.

The second object of the present invention is to provide a process for a ready commercial production of a top quality spinning pitch for the production of high performance carbon fibers.

The third object of the present invention is to provide a process for the production of mesophase pitches suitable for use in the production of carbon fibers without fluctuation of the qualities by a continuous thermal treatment, a continuous hydrogenation treatment, and a final thermal treatment.

Other object of the present invention will be apparent from the following detailed descriptions and examples by the persons skilled in the art.

Thus, the gist of the present invention resides in a process for the preparation of a mesophase pitch, characterized by having the first step of subjecting a heavy oil of petroleum or coal origin or a heavy component obtainable by a distillation, a heat treatment or a hydrotreatment thereof, the heavy oil or the heavy component having no quinoline insoluble fraction, to a continuous heat treatment in a tubular heater at a temperature of 400°-600° C. under an increased pressure, in the presence or absence of an aromatic oil in an amount of 0-2 times of the heavy oil or the heavy component, the aromatic oil having a boiling range of 180°-350° C. and being substantially free of components forming insoluble fractions in a monocyclic aromatic hydrocarbon solvent at the heat treatment in the tubular heater, subsequently transferring the thermally treated product to the first distillation or flash distillation column, distilling or flashing it therein and recovering a high softening point pitch having a softening starting temperature of 100°-200° C., a quinoline insoluble content of less than 2 wt% and a xylene insoluble content of more than 30 wt%, from the bottom of the column; the second step of subjecting the high softening point pitch to the second continuous thermal treatment in the second tubular heater in the presence of 1–5 times amounts of a hydrogen-donating solvent so as to hydrogenate the high softening point pitch, subsequently transferring the thermally treated product to the second distillation or flash distillation column, distilling or flashing it therein and recovering the hydrogenated pitch having a softening starting temperature of 100°–200° C., a quinoline insoluble content of less than 2 wt% and a xylene insoluble content of more than 30 wt%, from the bottom of the second distillation or flash distillation column; and the third step of subjecting the hydrogenated pitch to a heat treatment at a temperature of 380°–500° C. under a reduced or atmospheric pressure.

DETAILED DESCRIPTION OF THE INVENTION

In one preferred embodiment of the present invention, the process for the preparation of a mesophase pitch for the production of carbon fibers comprises the first step in which a heavy oil or a heavy component which does not contain quinoline insoluble fractions, and preferably contain no or substantially no xylene insoluble fraction, is continuously heated in the first continuous tubular heater at a temperature of 400°–600° C. under a pressure of 1–100 Kg/cm$^2$.G with a residence time of 10–2000 sec, in the presence or absence of aromatic oils, the thermally treated product is immediately sent to the first distillation or flash distillation column, distilled or flashed at a temperature of 300°–530° C., more preferably 350°–500° C., under a pressure of 0–3 Kg/cm$^2$.A, and a high softening point pitch containing less than 2 wt% of quinoline insoluble fractions and more than 30 wt% of xylene insoluble fractions and having a softening starting temperature of 100°–200° C. is recovered from the bottom of the first distillation or flash distillation column; the second step in which the high softening point pitch is continuously heated in the presence of 1–5 times amounts of a hydrogen-donating solvent at a temperature of 400°–460° C. under a pressure of 20–100 Kg/cm$^2$.G with a residence time of 10–120 min in the second continuous tubular heater so as to hydrogenate the high softening point pitch, and the thermally treated product is sent to the second distillation or flash distillation column, distilled or flashed at a temperature of 300°–530° C., preferably 350°–500° C., under a pressure of 0–3 Kg/cm$^2$.A, and the hydrogenated high softening point pitch containing less than 2 wt% of quinoline insoluble fractions and more than 30 wt% of xylene insoluble fractions and having a softening starting temperature of 100°–200° C. is recovered from the bottom of the second distillation or flash distillation column; and the third step in which the hydrogenated high softening point pitch is submitted to the third thermal treatment at a temperature of 380°–500° C., preferably 400°–480° C., under a reduced or atmospheric pressure.

The present invention will be explained in detail below in the order of the steps described above.

The raw materials which may be used in the present invention are heavy oils such as coal tars, hydrogenated coal tars, liquefied coals, tars from naphtha cracking (naphtha tars), tars from gas oil cracking (pyrolysis tars), and decant oils from catalytic cracking, or heavy components prepared from them, and they may be used either alone or as a mixture thereof. In general, the heavy oil has following chemical and physical properties shown in Table 1.

TABLE 1 (1)

| Chemical and physical characteristics of some kinds of heavy oil | | | |
|---|---|---|---|
| Kind of Heavy oil | Coal tar | Naphtha tar | Pyrolysis tar |
| Sp. Gr. (15/4° C.) | 1.10–1.20 | 1.05–1.10 | 1.05–1.15 |
| H/C Atomic ratio | 0.6–0.8 | 0.9–1.0 | 0.8–1.2 |
| Asphaltenes (wt %) | 15–40 | 10–20 | 10–25 |
| Xylene insolubles (wt %) | 2–20 | 0–1 | 0–10 |
| Quinoline insoubles (wt %) | 0.1–5.0 | less than 1 | less than 1 |
| Conradson carbon residue (wt %) | 15–30 | 10–20 | 10–25 |
| Distillation properties (°C.) | | | |
| IBP | 180–250 | 170–210 | 180–250 |
| 10 vol. % | 210–300 | 210–240 | 240–320 |
| 30 vol. % | 270–370 | 230–280 | 270–340 |
| 50 vol. % | 360–420 | 270–350 | 330–390 |
| 70 vol. % | 470–530 | 320–400 | 380–460 |

TABLE 1 (2)

| Chemical and physical characteristics of some kinds of heavy oil | | |
|---|---|---|
| Kind of Heavy oil | Decant oil | Hydrogenated coal tar |
| Sp. Gr. (15/4° C.) | 0.95–1.10 | 1.10–1.20 |
| H/C Atomic ratio | 1.2–1.5 | 0.8–1.0 |
| Asphaltenes (wt %) | 0–5 | 10–30 |
| Xylene insolubles (wt %) | 0–1 | 1–10 |
| Quinoline insolubles (wt %) | less than 1 | 0–2.0 |
| Conradson carbon (wt %) | 2–10 | 10–25 |
| Distillation properties (°C.) | | |
| IBP | 170–240 | 160–270 |
| 10 vol. % | 300–370 | 200–350 |
| 30 vol. % | 350–400 | 250–410 |
| 50 vol. % | 370–420 | 350–470 |
| 70 vol. % | 400–450 | 460–550 |

As shown in Table 1, some kinds of heavy oils contain xylene insoluble fractions and/or quinoline insoluble fractions. When these heavy oils are heat-treated in a tubular heater without removal of the insoluble fractions, undesirable fractions are formed and they significantly deteriorate the properties of mesophase pitches to be finally obtained. Moreover, coke-like solid material is easily formed and may cause the clogging of the heater tube.

After an intensive investigation to avoid the disadvantages, we found a method to prevent the formation of the undesirable fractions by the use of a specified heavy oil or heavy component which contains no quinoline insoluble fraction, and more preferably contains no quinoline insoluble fraction and no or substantially no xylene insoluble fraction as a raw material. Accordingly, if a heavy oil or heavy component contains a substantial amount of xylene insoluble fractions and/or quinoline insoluble fractions, the insoluble fractions are to be removed before subjecting the heavy oil or heavy component to the first heat treatment of the present invention. In case of a heavy oil or heavy component which contains no xylene and/or quinoline insoluble fraction, it is to be considered that the heavy oil or heavy component is ratently received the removal of the insoluble fractions.

As a method to remove the insoluble fractions from a raw material, any suitable processes known in the art can be used. And, in case that a coal tar is used as a raw material, the process we proposed in Japanese Patent Laid-open No. 61(1986)-238885 can be preferably used. This process is characterized by distilling a coal tar at a specified condition, mixing the heavy fraction thus obtained with a monocyclic aromatic hydrocarbon solvent at a specified ratio, removing insoluble fractions formed and recovering refined heavy component by removing the solvent used.

One characteristic feature of the present invention is to use a specified heavy oil or heavy component which contains no quinoline insoluble fraction, preferably no or sub-stantially no xylene insoluble fraction, or from which the insoluble fractions are previously removed, as a raw material. This specified heavy oil or heavy component is hereinafter referred to as "refind heavy component".

The first step of the present invention comprises a heat treatment of the refined heavy component in a tubular heater. When conducting this heat treatment, it is also preferable to exist an aromatic oil in the mixture to be treated. Such aromatic oil has a boiling range of 180°-350° C., and should not materially produce coke-like solid substance in conditions of the heat treatment in the tubular heater. The preferred aromatic oil may be a fraction obtainable by a distillation of the raw heavy oil and having a boiling range of 180°-350° C. The examples are wah oils and anthracene oils which are the 240°-280° C. fractions and the 280°-350° C. fractions, respectively, of coal tars. The lighter fractions, having a boiling range of above-mentioned, obtained from petroleum heavy oils can also be used. These aromatic oils help to avoid excessive thermal polymerization in the tubular heater, provide an adequate residence time so that the refined heavy component may be thermally decomposed sufficiently, and prevent coke clogging of the tubes. Those containing high boiling components in a large amount, therefore, are not usable as the aromatic oils specified above. On the other hand, those containing a large amount of lighter components, e.g., boiling below 180° C., are not favorable, because a higher pressure is required to keep them in liquid state in the tubular heater. The quantity of the aromatic oil to be used is less than 2 times amounts of the refined heavy component, and usually may be less than the quantity of the refined heavy component to be thermally treated. In case where the refined heavy component contains a sufficient amount of aromatic oils of the above-mentioned boiling range, the addition of the aromatic oils to the refined heavy component may be saved. It is preferable that the "feed oil" charged into the first tubular heater of the present invention contains the aromatic oil of more than 10 wt%, more preferably more than 20 wt%.

The conditions of the first heat treatment in the tubular heater can be selected from a temperature range of 400°-600° C. at an increased pressure, preferably a temperature range of 400°-600° C., a pressure range of 1-100 Kg/cm$^2$.G and a residence time range of 10-2000 sec, and more preferably a temperature range of 400°-530° C., a pressure range of 4-50 Kg/cm$^2$.G and a residence time range of 30-1000 sec. The temperature and the pressure mentioned above are measured at the outlet of the tubular heater, and the residence time mentioned above is calculated as a time of the materials charged into the tubular heater being at a temperature of higher than 400° C.

This thermal treatment brings about thermal decomposition and thermal polymerization. At temperatures below the specified range, the thermal decomposition and thermal polymerization take place with difficulty, and at temperatures above the specified range, there is an enhanced risk of clogging of the continuous tubular heater during the thermal treatment. By an operation under lower pressures, vaporization of the aromatic oils may arise and the vaporization induces clogging of the tube, and an operation under higher pressures is economically disadvantageous as it requires a large apparatus. A shorter residence time is enough at a higher temperature, and inversely, a longer one is required at a lower temperature, but temperatures within the range specified above are both effective and efficient.

The heat treatment at this first step has a great influence on the characteristics of the ultimate products, i.e., the mesophase pitch, and of the carbon fibers produced therefrom, though the reason therefor cannot be explained definitely, at least at the present, by the knowledge or findings so far acquired by or made available to us. This heat treatment can never be carried out in a batch-type pressurized heating facility such as a commonly used autoclave. The reason therefor is that since a batch-type apparatus which is incapable of effectively controlling the short residence time, and with such a batch system one cannot help employing a lower temperature to complement a longer residence time. But, we have experienced that the heat treatment at such conditions results the formation of a considerable amount of coke-like solid materials which are insoluble in quinoline.

Contrary to that, the thermally treated product obtained by the first heat treatment according to the present invention usually has a quinoline insoluble content of less than 1 wt%.

Since the first step of this invention requires a sufficient degree of thermal cracking reaction to take place while preventing the excessive thermal polymerization reaction, it is imperative that the heat treatment be conducted in a tubular heater under the specified conditions.

The thermally treated product is immediately sent to the first distillation or flash distillation column, the aromatic oil and lighter fractions are removed by a distillation or flash distillation at a temperature of 300°-530° C., preferably at 350°-500° C., under a pressure of 0-3 Kg/cm$^2$. A, and a high softening point pitch is recovered from the bottom of the first distillation or flash distillation column.

The condition of this first distillation or flash distillation column is decided so as to obtain a high softening point pitch having a softening starting temperature of 100°-200° C., quinoline insoluble contents of less than 2 wt%, usually less than 1 wt%, and xylene insoluble contents of more than 30 wt%, preferably more than 40 wt%.

Incidentally, the softening starting temperature was determined by heating a long and narrow aluminum plate with a temperature gradient along the length, placing the sample powders along the plate, brushing lightly off the samples and measuring the temperature of the spot where the samples begin to adhere.

Softening starting temperature (°C.)≈
Softening point by JIS ring and ball method—20° C.

This method was adopted because temperatures above 200° C. cannot be measured by JIS ring and ball method.

Pitches having softening starting temperature of below 100° C. contain considerable amounts of lighter fractions which cannot be converted to mesophase. Accordingly, it is not favorable to use such pitches as materials for the next hydro-treatment, because large amount of hydrogen-donating solvent is required in vain. On the other hand, it is also unfavorable to try to obtain pitches having softening starting temperature of higher than 200° C., because of increasing the amount of quinoline insoluble fractions. Moreover, such pitches having very high softening point are not easy to dissolve in the hydrogen-donating solvent used in the next step. In case of pitches having softening starting temperature of 100°-200° C., the pitches are obtainable in liquid state from the bottom of the first distillation or flash distillation column, and they can be directly dissolved in the hydrogen-donating solvent.

Further, the conditions of the first step should be selected not to form significant amounts of insoluble fractions when the high softening point pitch obtained from the bottom of the first distillation or flash distillation column is mixed with the hydrogen-donating solvent used in the next step. If such insoluble fractions exist in the mixture of the pitch and the hydrogen-donating solvent, the heat treatment in the presence of the hydrogen-donating solvent cannot be conducted continuously using a tubular heater. Accordingly, solubility of the pitch in the hydrogen-donating solvent should be also considered.

The pitch having the properties mentioned above is optically isotropic when observed by a polarized microscope. This high softening point pitch can be directly converted to a mesophase pitch by a heat treatment freely selected from the methods known in the art. However, when the mesophase pitch thus obtained has a mesophase content of more than 80%, the pitch has a very high softening point of over 330° C. measured by Mettler method, and it is not favorable for spinning. Accordingly, it is desirable to obtain a mesophase pitch having a low softening point, even if the mesophase pitch has a high mesophase content.

One preferable method to lower a softening point of a mesophase pitch ultimately obtained is to hydrogenate the high softening point pitch obtained by the first step of the present invention in the presence of a hydrogen-donating solvent.

The second step comprises a heat treatment of the high softening point pitch as described above in the presence of a hydrogen-donating solvent. After the high softening point pitch is dissolved in 1-5 times amounts of a hydrogen-donating solvent, the mixture is heat-treated in the second continuous tubular heater at a temperature of 400°-460° C., under a pressure of 20-100 $Kg/cm^2.G$ and with a residence time of 10-120 min. By this heat treatment, hydrogen atoms are transferred to the pitch from the hydrogen-donating solvent and the pitch is hydrogenated. Accordingly, the conditions of this second heat treatment significantly influence on the softening point of a mesophase pitch ultimately obtained.

The hydrogen-donating solvents used here are a hydrogenated aromatic compound, a mixture of hydrogenated aromatic compounds, or hydrogenated aromatic oil, and should substantially dissolve the high softening point pitch. Tetrahydroquinoline, 9,10-dihydroanthracene, hydrogenated anthracene oils, hydrogenated wash oil and hydrogenated lighter fractions of petroleum heavy oils used as raw materials in the present invention may be cited as examples. Considering the solvency of these solvent, tetrahydroquinoline, hydrogenated anthracene oils, hydrogenated wash oils are more preferable.

The amount of the hydrogen-donating solvent is 1-5 times of the high softening point pitch, usually 1-3 times.

As mentioned above, the conditions of the second heat treatment in a tubular heater influence on the properties of a mesophase pitch ultimately obtained. Generally speaking, at temperatures below 400° C., transfer of hydrogen atoms from the hydrogen-donating solvent to the high softening point pitch does not take place efficiently, and it becomes difficult to obtain a homogeneous low softening point mesophase pitch in the third step. On the other hand, when the temperature is higher than the specified range, unfavorable quinoline insoluble components are formed, moreover, the continuous operation becomes difficult because the tube may be clogged by coking reaction in the continuous tubular heater.

Under lower pressures than specified above, reaction of hydrogen transfer does not take place efficiently, moreover, under extraordinally low pressure the continuous tubular heater may cause clogging because of an excessive vaporization of the hydrogen-donating solvent and lighter fractions which are formed during the heat treatment. On the other hand, pressures above the specified range are economically disadvantageous because an enormous cost will be required for the apparatus.

A shorter residence time is enough at higher temperatures, and inversely, a longer one is required at lower temperatures, but temperature range and residence time range specified above are both effective and efficient.

This second heat treatment should never be conducted by a batch system. The reason is as same as in case of the first heat treatment. If this second heat treatment is conducted by a batch system, unfavorable quinoline insoluble fractions or coke-like solid substances are easily formed and they should be removed. This requires an additional operation and apparatus, and is uneconomical.

The heat-treated material in the second tubular heater is immediately sent to the second distillation or flash distillation column, distilled or flash distilled at a temperature of 300°-530° C., preferably at 350°-500° C., under a pressure of 0-3 $Kg/cm^2.A$. More preferably this second distillation or flash distillation is conducted at a temperature of 350°-480° C., under a pressure of 0-2 $Kg/cm^2.A$. In this second distillation or flash distillation column, the hydrogen-donating solvent used and lighter fractions which are formed during the second heat treatment are removed, and the hydrogenated high softening point pitch containing less than 2 wt%, usually less than 1 wt% of quinoline insoluble fractions and more than 30 wt%, usually more than 40 wt% of xylene insoluble fractions and having a softening starting temperature of 100°-200° C. is recovered from the bottom of the second distillation or flash distillation column. In case when enough temperature to assure the distillation cannot be maintained by direct transfer of the heat-treated products from the second continuous tubular heater, the heat-treated products can be heated as required with a suitable preheater.

In this second distillation or flash distillation column, also, the conditions should be decided so as to obtain the hydrogenated pitch specified above. Pitches having softening starting temperature of below 100° C. contain considerable amounts of lighter fractions which cannot be converted to mesophase. Accordingly, it is not favorable to use such pitches as materials for the next third heat treatment, because larger amounts of hydrogenated pitches must be treated. And, it is also unfavorable to try to obtain pitches having softening starting temperature of higher than 200° C., because of increasing the amount of quinoline insoluble fractions.

The third step is a heat treatment of the hydrogenated pitch at a temperature of 380°-500° C., preferably 380°-480° C., and more preferably 400°-480° C., under a reduced or atmospheric pressure. The method of this third heat treatment can be freely selected from the methods known in the art. For example, a method comprising a heat treatment using a batch-type heating apparatus while bubbling an inert gas or super heated vapor of water or light hydrocarbon oils for 1 to 10 hr, a method comprising a continuous heat treatment using a thin film evaporator, and so on, can be used for the third step of the present invention.

By this third heat treatment, the development of planar aromatic molecules takes place, and substantially isotropic hydrogenated pitch is converted to a mesophase pitch.

According to the process of the present invention, a homogeneous mesophase pitch containing less than 30 wt%, usually less than 20 wt%, of quinoline insoluble fractions and more than 80 wt%, usually more than 90 wt%, of xylene insoluble fractions and more than 80% of mesophase is obtained.

Temperatures below the specified range hinder the development of planar aromatic molecules and higher temperatures bring about an excessive formation of quinoline insoluble fractions even if the reaction time is shortened. A shorter holding time is required at higher temperatures, and inversely, a longer one is required at lower temperatures, but temperature range specified above is both effective and efficient.

When the first step and second step are conducted by batch processes by the use of an apparatus such as an autoclave, filtration of the product is inevitable because a large amount of coke-like quinoline insoluble fractions deposit on the inner surface of the wall of the apparatus and also disperse in the product pitch. Treatment of refined heavy component by the process of the present invention extremely reduces the quinoline insoluble fractions, and allows an efficient operation in a continuous manner.

The present invention discloses a process for the preparation of a spinning pitch for manufacturing of high performance carbon fiber from a refined heavy component which does not contain quinoline insoluble fractions, preferably contain no or substantially no xylene insoluble fraction. By performing the thermal treatment and the removal of the lighter fractions continuously in the first and second steps, the process of the present invention extremely reduces the formation of quinoline insoluble fractions, eliminates the need for the removal of quinoline insoluble fractions or coke-like solid substances which was required in the prior art, and permits a ready preparation of a homogeneous mesophase pitch by the thermal treatment in the third step. Excellent carbon fibers can be produced from the mesophase pitch prepared by the process of the present invention.

DESCRIPTION OF THE PREFERRED EMBODIMENTS

In the followings, the present invention will be described more materially by showing examples. It is to be noted, however, that the examples are given only for the purpose of illustration and therefore, the scope of this invention is not limited thereby.

Example 1

A coal tar with properties shown in Table 2 was flash distilled at 280° C. under atmospheric pressure to give a heavy component in 80.0 wt% based on the coal tar. After dissolving it in twice the amount of xylene, the insoluble fractions formed were eliminated by filtration, and the filtrate, after removal of xylene, was used as the refined heavy component. Properties of the heavy component and the refined heavy component are also shown in Table 2.

One weight part of this refined heavy component and one weight part of a wash oil were charged by different pumps to the first continuous tubular heater with an inner diameter of 6 mm and a length of 40 m which being immersed in a molten salt bath, and the mixture was heat-treated at 490°-530° C. under a pressure of 20 $Kg/cm^2.G$, and with a residence time of 228 sec. The heat-treated products were immediately sent to the first flash distillation column and flash distilled at 480° C. under atmospheric pressure to give high softening point pitches. Yields and the properties of the pitches are shown in Table 3.

One weight part of the high softening point pitches and 2 weight parts of the hydrogenated anthracene oil were mixed respectively and the resulting solution were pumped into the second continuous tubular heater with an inner diameter of 8 mm and a length of 60 m which being immersed in a molten salt bath, and were heated at 440° C. under a pressure of 50 $Kg/cm^2.G$, and with a residence time of 86 min. The heater effluents were heated further with a preheater, and immediately sent to the second distillation column, and were flash distilled at 460° C. under atmospheric pressure to give hydrogenated high softening point pitches. Yields and the properties of the hydrogenated pitches are also shown in Table 3.

Into 500 ml polymerization flasks, 100 g each of the hydrogenated high softening point pitches were respectively charged and were submitted to a heat treatment in a molten salt bath of a temperature of 450° C. under atmospheric pressure for a holding time of 105-150 min, during which period, nitrogen gas was bubbled through the pitch at a rate of 8.0 liter/min, respectively.

The mesophase pitches obtained were spun with a spining apparatus having a nozzle hole with a diameter of 0.25 mm and a length of 0.75 mm at a temperature of 348° C. The pitch fibers thus produced were rendered infusible at 320° C. for a holding time of 20 min in the air, and subsequently carbonized at 1000° C. in a nitrogen atmosphere to give carbon fibers.

The conditions of heat treatments and spinnings, and the properties of the mesophase pitches and carbon fibers obtained are listed in Table 4.

TABLE 2

| Properties of raw material, heavy component, refined heavy component | Coal tar | Heavy component | Refined heavy component |
|---|---|---|---|
| Sp. Gr. (15/4° C.) | 1.164 | 1.201 | 1.155 |
| H/C Atomic ratio | 0.73 | 0.74 | 0.73 |
| Asphaltenes (wt %) | 22.8 | 29.4 | 25.2 |
| Xylene insolubles (wt %) | 4.7 | 6.3 | 0.9 |
| Quinoline insolubles (wt %) | 0.6 | 1.1 | 0 |
| Conradson carbon residue (wt %) | 25.2 | 30.9 | 28.2 |
| Distillation properties (°C.) | | | |
| IBP | 189 | 222 | 222 |
| 10 vol. % | 222 | 273 | 282 |
| 30 vol. % | 322 | 352 | 347 |
| 50 vol. % | 401 | 422 | 400 |
| 70 vol. % | 486 | 508 | 471 |

TABLE 3

| Properties of high softening point pitches obtained in the first and the second steps | | | | |
|---|---|---|---|---|
| Experiment No. | 1 | 2 | 3 | 4 |
| [First step] | | | | |
| Heat treatment temp. (°C.) | 490 | 510 | 520 | 530 |
| Pitch Yield (on refined heavy component) (wt %) | 27.1 | 28.6 | 30.3 | 32.2 |
| Softening starting temp. (°C.) | 152 | 156 | 163 | 169 |
| Xylene insolubles (wt %) | 48.5 | 52.9 | 59.8 | 67.2 |
| Quinoline insolubles (wt %) | 0.1 | 0.2 | 0.3 | 0.9 |
| [Second step] | | | | |
| Pitch yield (on refined heavy component) (wt %) | 22.2 | 24.3 | 26.6 | 27.9 |
| Softening starting temp. (°C.) | 170 | 176 | 182 | 187 |
| Xylene insolubles (wt %) | 48.7 | 52.0 | 54.0 | 58.2 |
| Quinoline insolubles (wt %) | 0.4 | 0.5 | 0.7 | 1.2 |

TABLE 4

| Properties of mesophase pitches and carbon fibers | | | | |
|---|---|---|---|---|
| Experiment No. | 1 | 2 | 3 | 4 |
| [Mesophese pitch] | | | | |
| Holding time of the third heat treatment (min) | 150 | 150 | 120 | 105 |
| Softening starting temp. (°C.) | 277 | 273 | 279 | 276 |
| Softening point by Mettler method (°C.) | 316 | 317 | 322 | 319 |
| Xylene insoubles (wt %) | 95.5 | 95.2 | 92.3 | 94.3 |
| Quinoline insolubles (wt %) | 16.0 | 13.3 | 15.7 | 13.2 |
| Mesophese content (%) | 90 | 90 | 95 | 85 |
| [Carbon fibers] | | | | |
| Tensile strength (Kg/mm$^2$) | 267 | 268 | 258 | 242 |
| Modulus of elasticity (ton/mm$^2$) | 15.3 | 15.6 | 15.1 | 14.2 |

Example 2

One part of the refined heavy component shown in Table 2 and 0.75 weight part of wash oil were heat-treated at a temperature of 510° C., under a pressure of 20 Kg/cm$^2$.G and with a residence time of 228 sec in the same tubular heater as in Example 1, and flash distilled under the same conditions as in Example 1, to give a high softening point pitch having a softening starting temperature of 162° C., a xylene insoluble content of 55.8 wt% and a quinoline insoluble content of 0.3 wt%, and the pitch yield was 29.2 wt% based on the refined heavy component.

One weight part of the high softening point pitch was mixed with 3 weight parts of hydrogenated anthracene oil. The mixture was continuously heat-treated in a tubular heater and flash distilled under the conditions identical with those of Example 1. The hydrogenated pitch has a softening starting temperature of 185° C., a xylene insoluble content of 53.2 wt% and a quinoline insoluble content of 0.3 wt%, and the yield of the hydrogenated pitch was 23.0 wt% based on the refined heavy component.

This hydrogenated pitch was heat-treated at a molten salt bath temperature of 450° C., with a holding time of 140 min by the same manner as in Example 1. The mesophase pitch obtained had a softening starting temperature of 277° C., a softening point of 316° C. measured by Mettler method, a xylene insoluble content of 95.6 wt%, a quinoline insoluble content of 11.4 wt% and a mesophase content of about 100%.

The carbon fibers produced from the mesophase pitch by the same manner as in Example 1 had a tensile strength of 269 Kg/mm$^2$ and a modulus of elasticity of 15.8 ton/mm$^2$.

Example 3

One part of the high softening point pitch obtained through the first step in Experiment No. 1 shown in Table 3, was mixed with 2 parts of hydrogenated quinoline, which contains 60 wt% of tetrahydroquinoline, and the mixture was heat-treated in the same tubular heater and under the same conditions as used in Example 1. Then, the heat-treated product was flash distilled at a temperature of 455° C., to give a hydrogenated pitch having a softening starting temperature of 173° C., a xylene insoluble content of 46.5 wt% and a quinoline insoluble content of 0.3 wt%.

This hydrogenated pitch was heat-treated at a molten salt bath temperature of 450° C., with a holding time of 180 min. The mesophase pitch obtained had a softening starting temperature of 277° C., a softening point of 314° C. by Mettler method, a xylene insoluble content of 93.9 wt%, a quinoline insoluble content of 14.9 wt% and a mesophase content of 100%.

The carbon fibers produced from the mesophase pitch by the same manner as in Example 1 had a tensile strength of 263 Kg/mm$^2$ and a modulus of elasticity of 15.6 ton/mm$^2$.

Example 4

One part of the high softening point pitch obtained in Example 2 was mixed with 2 parts of the hydrogenated anthracene oil and heat-treated in the same tubular heater as Example 1 at a temperature of 420° C., under a pressure of 50 Kg/cm$^2$.G and with a residence time of 83 min. The heat-treated product was flash distilled under the conditions identical with Example 1, to give a hydrogenated pitch having a softening starting temperature of 171° C., a xylene insoluble content of 55.2 wt% and a quinoline insoluble content of 0.4 wt%.

This hydrogenated pitch was heat-treated at a molten salt bath temperature of 450° C., with a holding time of 135 min. The mesophase pitch obtained had a softening starting temperature of 272° C., a softening point of 318° C. by Mettler method, a xylene insoluble content of 91.2 wt%, a quinoline insoluble content of 18.7 wt% and mesophase content of 90%.

The carbon fibers produced from the mesophase pitch by the same manner as in Example 1 had a tensile strength of 264 Kg/mm$^2$ and a modulus of elasticity of 14.6 ton/mm$^2$.

Example 5

This example is given for comparison and is not within the scope of the present invention.

When the heavy component shown in Table 2 was submitted, with removal of neither free carbons nor xylene insoluble fractions and without using any aromatic oil as a diluent, to the first step under the conditions identical with those of Example 2, the first continuous tubular heater was clogged after about 3 hr.

Example 6

This example is given for comparison purpose and is not within the scope of the present invention.

The refined heavy component shown in Table 2 in Example 1 was heat-treated in an autoclave at 490° C. for 5 min, and during this heat treatment, the pressure was maintained at 20 Kg/cm$^2$.G. And, it took about 2 hr to heat the refined heavy component up to 490° C. After cooling and taking out the heat-treated product from the autoclave, coke-like substance was found to be deposited on the inner surface of the wall of the autoclave. Lighter fractions were removed from the heat-treated product by vacuum distillation to give a high softening point pitch with a softening starting temperature of 160° C., and quinoline insoluble content of 2.0 wt%. When the pitch thus obtained was charged, without filtration, to a 1 liter autoclave together with twice the amounts of tetrahydroquinoline, and heated at 440° C. for 80 min under a autogeneous pressure, coke-like substance was found to be deposited on the inner surface of the wall of the autoclave.

The hydrogenated pitch, obtained after removal of the solvent, had quinoline insoluble content of 3.5 wt%. The pitch was subjected to a heat treatment by the same manner as in Example 1, with a holding time of 100 min, to give a mesophase pitch with a softening starting temperature of 275° C. and quinoline insoluble content of 30.3 wt%. Attempted spinning of this pitch under the same conditions as Example 1 was not successful because of frequent breaking off of fibers.

We claim:

1. A process for the preparation of a mesophase pitch, comprising a first step of subjecting a heavy oil of petroleum or coal origin or a heavy component obtainable by a distillation, a heat treatment or a hydro-treatment of said heavy oil, said heavy oil or said heavy component having no quinoline insoluble fraction, to a continuous heat treatment in a tubular heater at a temperature of 400°-600° C. under a pressure of 1 to 100 kg/cm$^2$.G for 10 to 2000 sec and subsequently transferring the thermally treated product to a first distillation or flash distillation column, distilling or flashing it therein under a pressure of 0-3 kg/cm$^2$.A at a temperature of 300°-530° C. and recovering a high softening point isotropic pitch having a softening starting temperature of 100°-200° C., a quinoline insoluble content of less than 2 wt% and a xylene insoluble content of more than 30 wt%, from the bottom of said column;

a second step of subjecting said high softening point pitch to a second continuous thermal treatment in a second tubular heater in the presence of 1-5 times amount of a hydrogen-donating solvent selected from the group consisting of tetrahydroquinoline, 9,10-dihydroanthracene, hydrogenated anthracene oil, hydrogenated wash oil, hydrogenated lighter fraction of naphtha tar, hydrogenated lighter fraction of pyrolysis tar and hydrogenated lighter fraction of decant oil, at a temperature of 400°-460° C. under a pressure of 20-100 Kg/cm$^2$.G for 10-120 min, so as to hydrogenate said high softening point isotropic pitch, subsequently transferring the thermally treated product to the second distillation or flash distillation column, distilling or flashing it therein at a temperature of 300° C. to 530° C. under a pressure of 0-3 kg/cm$^2$.A and recovering the substantially isotropic hydrogenated pitch having a softening starting temperature of 100°-200° C., a quinoline insoluble content of less than 2 wt% and a xylene insoluble content of more than 30 wt%, from the bottom of said second distillation or flash distillation column; and a third step of subjecting said substantially isotropic hydrogenated pitch to a heat treatment at a temperature of 380°-500° C. under a reduced or atmospheric pressure to convert said substantially isotropic hydrogenated pitch to a mesophase pitch.

2. The process as claimed in claim 1, wherein said heat treatment of said first step is conducted at a temperature of 400°-530° C., under a pressure of 4-50 Kg/cm$^2$.G, and with a residence time of 30-1000 sec.

3. The process as claimed in claim 1, wherein said hydrogen-donating solvent is selected from the group consisting of tetrahydroquinoline, hydrogenated anthracene oil and hydrogenated wash oil.

4. The process as claimed in claim 1, wherein said mesophase pitch has a Mettler method softening point of lower than 330° C., a quinoline insoluble content of lower than 30 wt%, a xylene insoluble content of more than 80 wt% and a mesophase content of more than 80% when examined on a polarized microscope.

5. The process as claimed in claim 1, wherein said heat treatment in said first step is conducted in the presence of an aromatic oil added in an amount of up to twice amount to said heavy oil or heavy component, said aromatic oil having a boiling range of 180°-350° C. and being substantially free of components forming insoluble fractions in a monocyclic aromatic hydrocarbon solvent at said continuous heat treatment in said tubular heater.

6. The process as claimed in claim 5, wherein said aromatic oil is added in an amount of 0.1 to 1 times the amount of heavy oil or heavy component.

* * * * *